US009565914B1

(12) United States Patent
Marraccini

(10) Patent No.: US 9,565,914 B1
(45) Date of Patent: Feb. 14, 2017

(54) MULTI-PURPOSE STORAGE POUCH

(71) Applicant: Julie Marraccini, Lake Wylie, SC (US)

(72) Inventor: Julie Marraccini, Lake Wylie, SC (US)

( * ) Notice: Subject to any disclaimer, the term of this patent is extended or adjusted under 35 U.S.C. 154(b) by 0 days.

(21) Appl. No.: 14/920,017

(22) Filed: Oct. 22, 2015

Related U.S. Application Data

(60) Provisional application No. 62/069,383, filed on Oct. 28, 2014.

(51) Int. Cl.

| | |
|---|---|
| ***A45C 1/06*** | (2006.01) |
| ***A45C 13/02*** | (2006.01) |
| ***A45C 11/24*** | (2006.01) |
| ***A45C 13/10*** | (2006.01) |
| ***A45C 13/30*** | (2006.01) |

(52) U.S. Cl.
CPC ..... *A45C 13/02* (2013.01); *A45C 11/24* (2013.01); *A45C 13/10* (2013.01); *A45C 13/30* (2013.01); *A45C 2013/1015* (2013.01)

(58) Field of Classification Search
CPC ..... A45C 1/06
USPC ..... 150/131, 134, 136, 139, 147–149
See application file for complete search history.

(56) References Cited

U.S. PATENT DOCUMENTS 540,661 A * 6/1895 Rood ..... A44B 13/0023 24/697.1
2,446,009 A * 7/1948 Hyman ..... A24F 15/18 150/106
2,511,533 A * 6/1950 Hyman ..... A45C 1/06 150/139
D161,822 S * 2/1951 Chase ..... 150/147
3,903,945 A * 9/1975 Skeba ..... A45C 1/06 150/133
4,570,688 A * 2/1986 Williams ..... A45C 1/04 150/102
4,881,684 A * 11/1989 Chinman ..... A45C 3/00 190/115
5,799,774 A * 9/1998 Dengel ..... A45C 1/06 150/147
6,457,635 B1 * 10/2002 Scicluna ..... B65D 85/182 206/278
8,672,135 B1 * 3/2014 Hymack ..... A47J 47/14 206/542

* cited by examiner

*Primary Examiner* — Sue A Weaver
(74) *Attorney, Agent, or Firm* — Kyle A. Fletcher, Esq.

(57) ABSTRACT

The multi-purpose storage pouch is further defined with an inner surface and an outer surface. The storage pouch has an overall shape of a plus sign. The storage pouch folds at each of four armatures to enclose the inner surface. The inner surface includes of the storage pouch includes a plurality of pockets or retaining members that secure a plurality of items to the interior of the storage pouch. The armatures each include a nylon hook or loop strip that enables the armatures to secure one another, and therefore enclose the inner surface. The top armature includes a pocket with a translucent member that enables objects to be seen there through. The storage pouch includes a pair of grommets that enable a cord member to extend from the interior of the storage pocket. The outer surface may include one or more exterior pockets.

11 Claims, 6 Drawing Sheets

MULTI-PURPOSE STORAGE POUCH

CROSS REFERENCES TO RELATED APPLICATIONS

This non-provisional patent application claims priority to provisional patent application 62/069,383 that was filed on Oct. 28, 2014.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of storage pouches, more specifically, a storage pouch that unfolds flat to expose a plurality of pockets.

SUMMARY OF INVENTION

The multi-purpose storage pouch generally comprises a storage pouch with an inner surface and an outer surface. The storage pouch has an overall shape of a plus sign. The storage pouch folds at each of four armatures to enclose the inner surface. The inner surface of the multi-purpose storage pouch includes a plurality of pockets or retaining members that secure a plurality of items to the interior of the storage pouch. The armatures each include a hook and loop fasteners that enables the armatures to secure one another, and therefore enclose the inner surface. The top armature includes a pocket with a translucent member that enables objects to be seen there through. The storage pouch includes a pair of grommets that enable a cord member to extend from the interior of the storage pocket. The cord member is optionally used to carry the device. The outer surface may include one or more exterior pockets.

These together with additional objects, features and advantages of the multi-purpose storage pouch will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-purpose storage pouch in detail, it is to be understood that the multi-purpose storage pouch is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-purpose storage pouch.

It is therefore important that the claims be regarded as including such equivalent construction insofar as they do not depart from the spirit and scope of the multi-purpose storage pouch. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
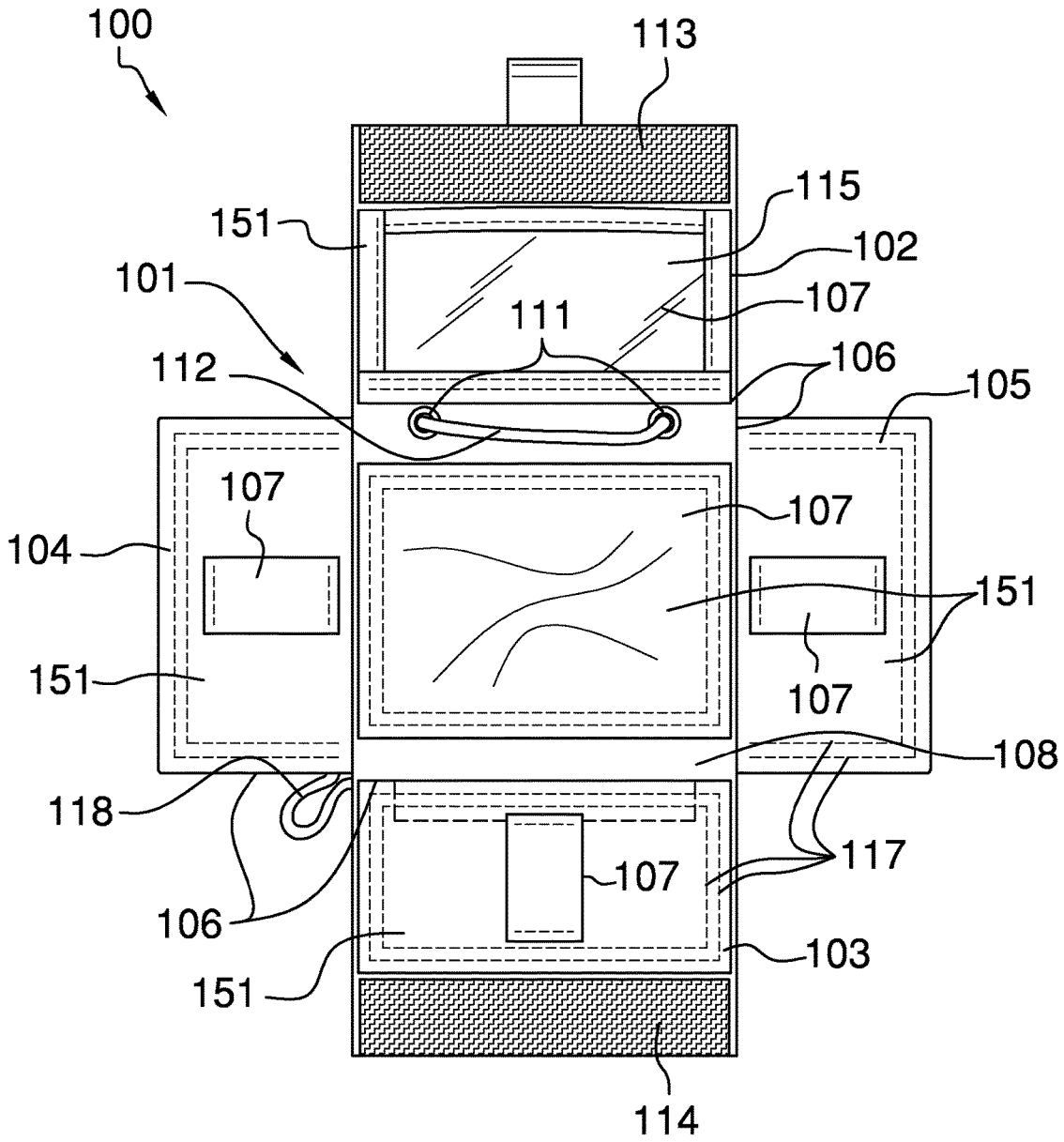
FIG. 1 is a view of an inner surface of an embodiment of the disclosure.
Figure 2:
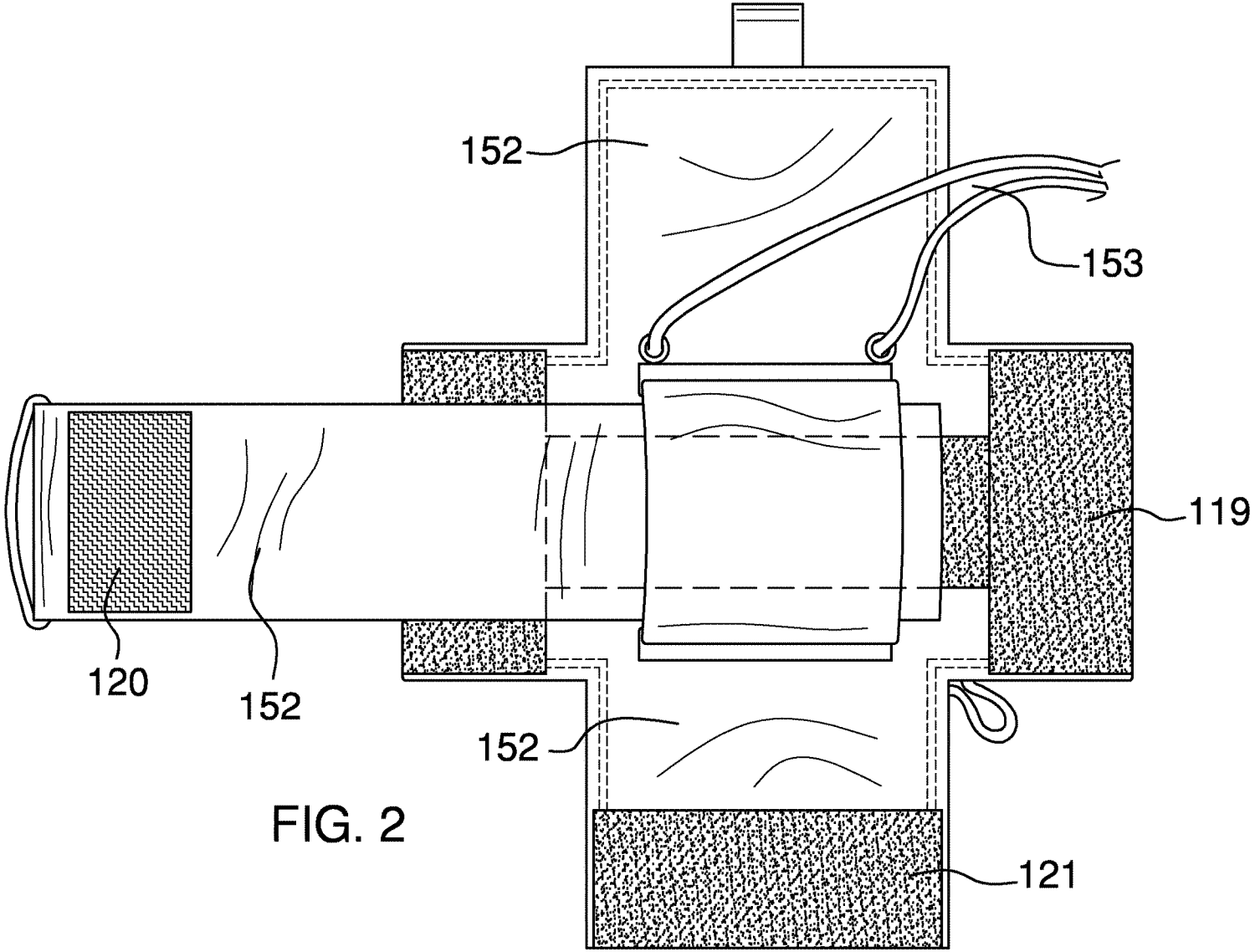
FIG. 2 is a view of an outer surface of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

As best illustrated in FIGS. 1 through 7, the multi-purpose storage pouch 100 (hereinafter invention) generally comprises a planar member 101 that is in the overall shape of a plus sign. The planar member 101 is further defined with four armatures that may be characterized as a top armature 102, a bottom armature 103, a left armature 104, and a right armature 105. The top armature 102, the bottom armature 103, the left armature 104, and the right armature 105 are each attached to a center panel 108. The center panel 108 is the centralized portion of the invention 100. The invention 100 is further defined with an inner surface 151 and the outer surface 152. The outer surfaces 152 are the surfaces of the invention 100 that are visible when the invention 100 in closed and the surfaces of the top armature 102, the bottom armature 103, the left armature 104, and the right armature 105 that would extend the surface of the outer surface 152. The inner surface 151 is formed by those surfaces, which are not outer surfaces 152.

The four armatures fold at a crease line 106 in order to enclose the inner surface 151. A crease line 106 is located at each joint where the top armature 102, the bottom armature 103, the left armature 104, and the right armature 105 is attached to the center panel 108. The left armature 104 and right armature 105 fold over the inner surface 151 before the top armature 102 and bottom armature 103 fold. The top armature 102 includes a first hook or loop surface 113 that is used to secure the top armature 102 to the bottom armature 103 and conceal the inner surface 151. The bottom armature 103 includes a second hook or loop surface 114 that is used to secure the bottom armature 103 to the left armature 103 and the right armature 104 and a fifth hook or loop surface 121 to secure the bottom armature 103 to the top armature 102. The outer surface 152 of the left armature 104 has attached to it a third hook or loop surface 119. The outer surface 152 of the right armature 105 has attached a fourth hook or loop surface 120.

Figure 3:
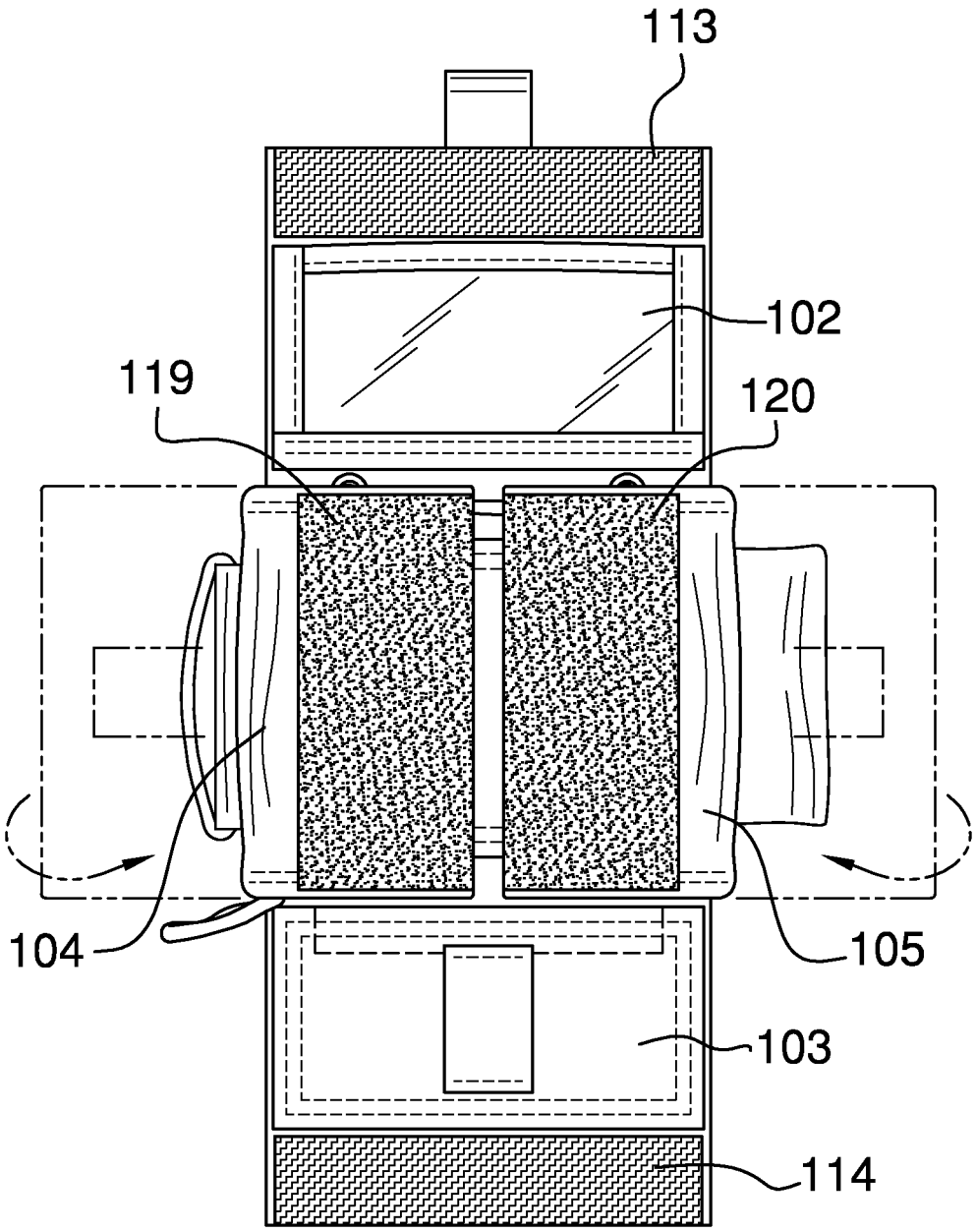
FIG. 3 is a detailed in use view of an embodiment of the disclosure.
Figure 4:
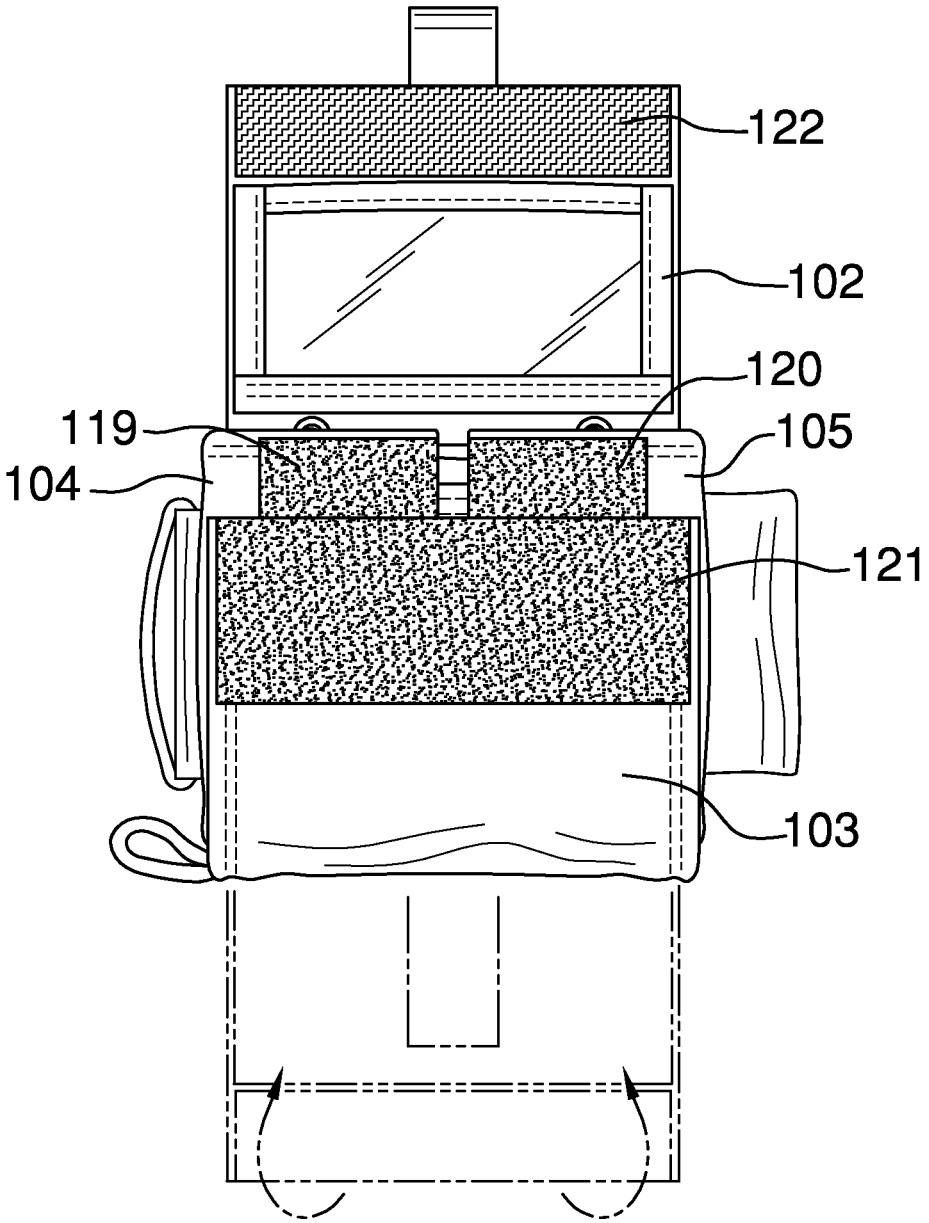
FIG. 4 is a detailed in use view of an embodiment of the disclosure.
Figure 5:
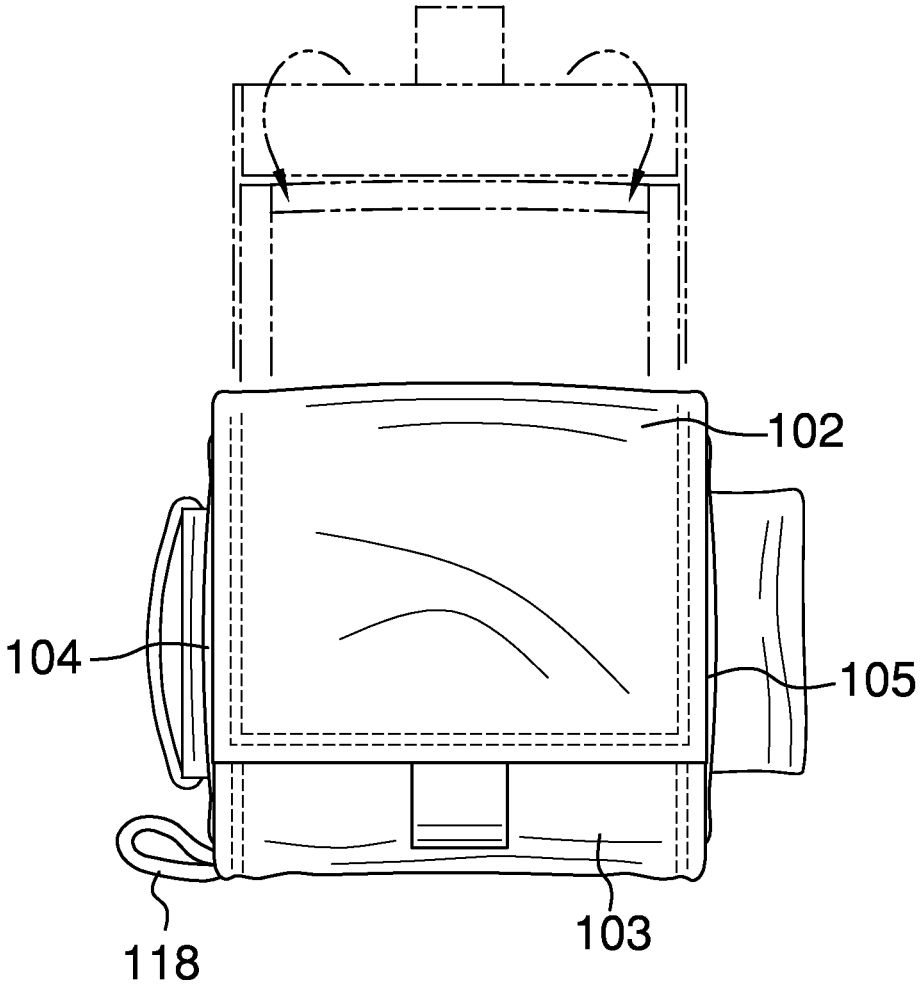
FIG. 5 is a detailed in use view of an embodiment of the disclosure.
Figure 6:
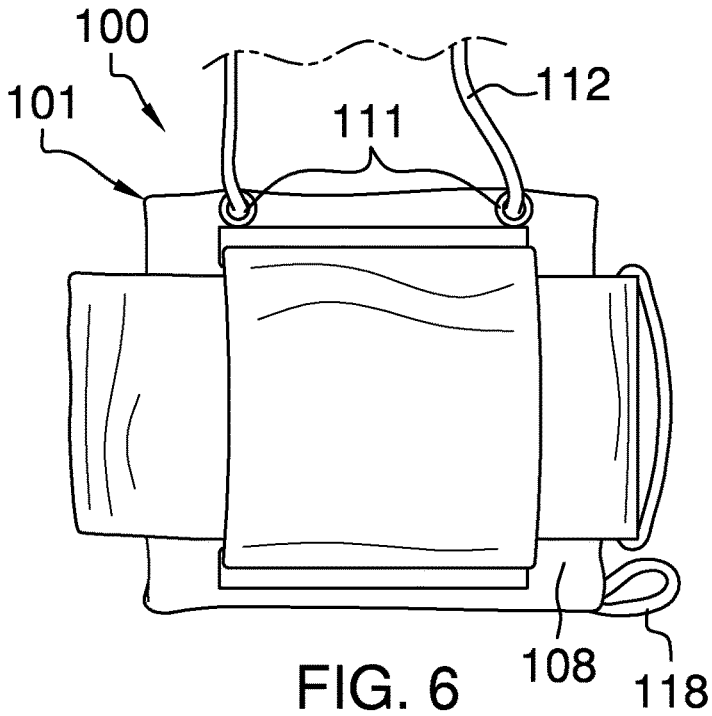
FIG. 6 is a closed view of an embodiment of the disclosure.
Figure 7:
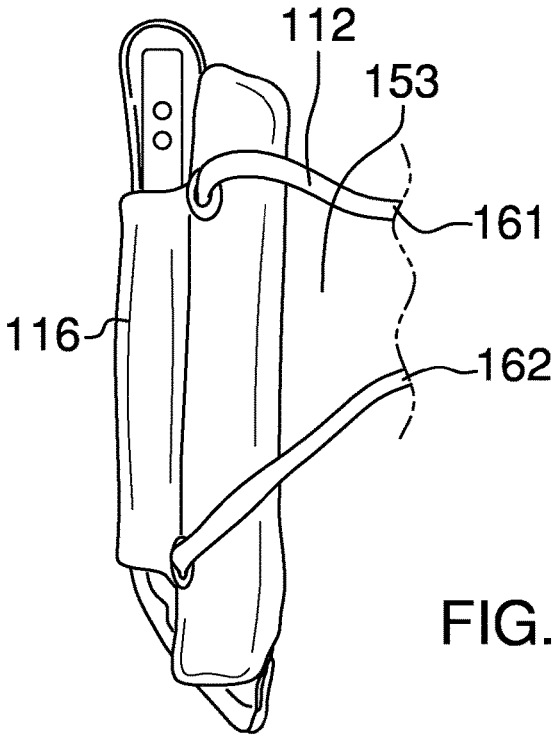
FIG. 7 is a closed side view of an embodiment of the disclosure.

As shown in FIGS. 3 through 5, the invention 100 is closed as follows. As shown in FIG. 3, the left armature 104 and the right armature 105 are folded such that they are touching the inner surface 151 of the center panel 108 exposing the third hook or loop surface 119 and the fourth hook and loop surface 120. As shown in FIG. 4, the bottom armature 103 is folded on top of the left armature 104 and right armature 105 such that the second hook or loop surface 114 attaches to the third hook or loop surface 119 and the fourth hook or loop surface 120. This exposes the fifth hook or loop surface 121. As shown in FIG. 5, the closing is completed when the top armature 102 is folded on top of the outer surface 102 of the bottom armature 103 such that the first hook or loop surface 113 attaches to the fifth hook or loop surface 121. To open the invention 100, the reverse of the above procedure is performed.

The inner surfaces 151 of the top armature 102, the bottom armature 103, the left armature 104, the right armature 105, and the center panel 108 include a plurality of pockets 107 and/or retaining members that are adapted to secure and store a plurality of items therein. One of the plurality of pockets 107 located on the inner surface 151 includes a first ID pocket 115. It is preferred that the first ID pocket 115 be located on the inner surface 151 of the top armature 102 such that the first ID pocket 115 can be made visible without having to open the entire invention 100. The first ID pocket 115 is a pocket selected from the plurality of pockets 107 that is formed with an aperture that is covered with a transparent plastic sheeting. The first ID pocket 115 permits the display of identification without having to remove the identification from the first ID pocket 115.

The balance of the invention 100 includes one or more exterior pockets 116, a pair of grommets 111, a cord member 112 and a handle loop 118. The cord member 112 is further defined with a first end 161 and a second end 162. The pair of grommets 111 enable the first end 161 of a cord member 112 and the second end 162 of the cord member 112 of to extend from the inner surfaces 151 (or interior) of the invention 100 when the invention 100 is folded to enclose the inner surface 151. The cord member 112 is used to carry the invention 100. The cord member 112 is formed from the commercial version of United States Department of Defense Specification MIL-C-5040H (also referred to as 550 paracord) that has an overall length of not less than 1 foot, but not more than 20 feet. The cord member 112 is further defined with a first end 161 and a second end 162. The cord member 112 is formed into a loop 153 with a fisherman's knot or a double fisherman's knot so as to enable adjustment of the loop 153 formed on the cord member. The loop 153 is adjusted by adjusting the relative position of the relative position of the double overhand (or overhand) knot of the first end 161 to the double overhand (or overhand) knot of the second end 162. The pair of grommets 111 are located on the center panel 108 side of the crease line 106 that is formed between the top armature 102 and the center panel 108. The one or more exterior pockets 116 are pockets that are formed on the outer surface 152 of the invention 100. The handle loop 118 is a loop that is formed from the same material as the cord member 112. The handle loop 118 is sized and positioned to provide a convenient grip for carrying the invention 100.

In the first potential embodiment of the invention 100, the planar member 101 as well as the plurality of pockets 107 are made of a textile, which may be coated in a waterproofing agent so as to enable the invention 100 to be relatively water resistant. The planar member 101 and the plurality of pockets 107 are joined using sewn seams 117.

The following definitions were used in this disclosure:

Fastener: As used in this disclosure, a fastener is a device that is used to join or affix two objects. Fasteners generally comprise a first part which is attached to the first object and a second part which is attached to the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface. A note on usage: when fastening a two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook or loop fastener or the loop surface of a hook and loop fastener is attached objects are fastened together one of the two objects will have a hook surface and the remaining object will have the loop surface.

Pocket: As used in this disclosure, a pocket is a small pouch that is formed into an object. Pockets are often formed by joining a second textile or a second sheeting to a first textile or a first sheeting, respectively, by sewing or heat sealing respectively.

Sheeting: As used in this disclosure, sheeting is a material, such as cloth or plastic, in the form of a thin flexible layer or layers that is used to cover something.

Textile: As used in this disclosure, a textile is a material that is woven, knitted, or felted. Synonyms in common usage for this definition include fabric and cloth.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A multi-purpose storage pouch comprising:

a planar member having a plus sign shape that is further defined as four armatures encircling a central panel;

said planar member is further defined as an inner surface and an outer surface;

wherein said four armatures each fold at a crease line in order to enclose the inner surface;

wherein a pair of grommets are integrated into the planar member;

wherein the pair of grommets enable a cord member to extend from an interior;

wherein the planar member is further comprises a top armature, a bottom armature, a left armature, and a right armature and said center panel;

wherein the top armature attaches to the center panel;

wherein the bottom armature attaches to the center panel;

wherein the left armature attaches to the center panel;

wherein the right armature attaches to the center panel;

wherein the top armature further comprises a first hook or loop surface;

wherein the bottom armature further comprises a second hook or loop surface and a third hook or loop surface;

wherein the left armature further comprises a fourth hook or loop surface;

wherein the right armature further comprises a fifth hook or loop surface;

wherein the left armature folds onto the center panel such that the inner surface of the left armature faces the inner surface of the center panel;

wherein the right armature folds onto the center panel such that the inner surface of the right armature faces the inner surface of the center panel;

wherein the inner surface of the bottom armature folds onto the outer surface of the left armature;

wherein the inner surface of the bottom armature folds onto the outer surface of the right armature;

wherein the second hook or loop surface on the inner surface attaches to the fourth hook or loop surface on the outer surface;

wherein the second hook and loop surface on the inner surface attaches to the fifth hook or loop surface on the outer surface.

2. The multi-purpose storage pouch according to claim 1 wherein the inner surface of the top armature fold onto the outer surface of the bottom armature.

3. The multi-purpose storage pouch according to claim 2 wherein the first hook or loop surface on the inner surface attaches to the third hook or loop surface on the outer surface.

4. The multi-purpose storage pouch according to claim 3 wherein the inner surface of the planar member further comprises a plurality of pockets and/or retaining members that are adapted to secure and store a plurality of items therein.

5. The multi-purpose storage pouch according to claim 4 wherein the plurality of pockets further comprises a first ID pocket.

6. The multi-purpose storage pouch according to claim 5 wherein the first ID pocket is located on the inner surface of the top armature.

7. The multi-purpose storage pouch according to claim 6 wherein the outer surface further comprises one or more exterior pockets.

8. The multi-purpose storage pouch according to claim 7 wherein the pair of grommets is located on the central panel.

9. The multi-purpose storage pouch according to claim 8 wherein the a cord member is formed from 550 paracord;

wherein the cord member further comprises a first end and a second end.

10. The multi-purpose storage pouch according to claim 9 wherein the first end and the second end are joined to form a loop.

11. The multi-purpose storage pouch according to claim 10 wherein a handle loop is attached to the outer surface.

* * * * *